US008790155B2

(12) United States Patent
Stroppel

(10) Patent No.: US 8,790,155 B2
(45) Date of Patent: Jul. 29, 2014

(54) GRINDING MACHINE AND METHOD FOR GRINDING AND DEBURRING

(75) Inventor: Berthold Stroppel, Sigmaringen (DE)

(73) Assignee: Schaudt Mikrosa GmbH, Leipzig (DE)

( * ) Notice: Subject to any disclaimer, the term of this patent is extended or adjusted under 35 U.S.C. 154(b) by 0 days.

(21) Appl. No.: 13/452,499

(22) Filed: Apr. 20, 2012

(65) Prior Publication Data

US 2012/0252316 A1 Oct. 4, 2012

Related U.S. Application Data

(63) Continuation of application No. PCT/EP2010/065468, filed on Oct. 14, 2010.

(30) Foreign Application Priority Data

Oct. 20, 2009 (DE) ..... 10 2009 051 586

(51) Int. Cl.
*B24B 1/00* (2006.01)
*B24B 49/12* (2006.01)

(52) U.S. Cl.
USPC ..... 451/5; 451/6; 451/9; 451/10; 451/58; 451/62; 451/179; 451/246; 451/254

(58) Field of Classification Search
USPC ..... 451/5, 6, 8, 9, 10, 11, 13, 49, 57, 58, 451/62, 178, 179, 246, 254, 278, 279, 541, 451/547
See application file for complete search history.

(56) References Cited

U.S. PATENT DOCUMENTS

| | | | | |
|---|---|---|---|---|
| 4,905,418 | A * | 3/1990 | Wedeniwski | 451/5 |
| 4,907,374 | A | 3/1990 | Brill | |
| 5,259,150 | A | 11/1993 | Himmelsbach | |
| 5,274,961 | A * | 1/1994 | Himmelsbach et al. | 451/547 |
| 5,829,131 | A * | 11/1998 | DeSloover et al. | 29/888.1 |
| 2011/0009031 | A1 | 1/2011 | Honegger et al. | |

FOREIGN PATENT DOCUMENTS

| | | |
|---|---|---|
| DE | 37 24 698 A1 | 2/1989 |
| DE | 41 03 090 C1 | 8/1992 |
| DE | 102 05 212 A1 | 8/2003 |

(Continued)

OTHER PUBLICATIONS

International Search Report with Written Opinion of the International Searching Authority, dated Mar. 18, 2011, corresponding to PCT/EP2010/065468, 10 pages.

(Continued)

*Primary Examiner* — Timothy V Eley
(74) *Attorney, Agent, or Firm* — Christie, Parker & Hale, LLP

(57) ABSTRACT

The present invention relates to a grinding machine for grinding a workpiece, in particular cams, with a grinding wheel having a profile with a grinding region running substantially parallel to the axis of rotation of the grinding wheel and at least one profile section which does not run parallel to the axis of rotation of the grinding wheel, a control unit for controlling the grinding process, wherein the control unit is configured in such a manner that, with reference to position information on positions of edges of the workpiece in the direction of the longitudinal axis of the workpiece, the edges of the workpiece are successively deburred or chamfered by the at least one profile section of the grinding wheel during or after the grinding of the workpiece.

14 Claims, 10 Drawing Sheets

(56) References Cited

FOREIGN PATENT DOCUMENTS

| | | | |
|---|---|---|---|
| EP | 2 106 880 | A2 | 10/2009 |
| GB | 2 208 275 | A | 3/1989 |
| GB | 2 455 913 | A | 1/2009 |
| JP | 2009 154262 | A | 7/2009 |
| WO | WO 2009/023979 | A1 | 2/2009 |

OTHER PUBLICATIONS

Studer Schaudt GmbH, "Cam-Grind—Production Solutions for the Grinding of Camshafts," Stuttgart, Oct. 2006, 23 pages.

Studer Schaudt GmbH, "The range—Your application defines the solution," Stuttgart, 8 pages.

* cited by examiner

GRINDING MACHINE AND METHOD FOR GRINDING AND DEBURRING

CROSS-REFERENCE TO RELATED APPLICATION

The present application claims the benefit of the earlier filing date of DE 10 2009 051 586.0 filed in the German Patent and Trademark Office on Oct. 20, 2009 and is continuation application of the international patent application PCT/EP 2010/065468 filed on Oct. 14, 2010, the entire content of which applications is incorporated herein by reference.

BACKGROUND

1. Field of the Disclosure

The present invention relates to a grinding machine for grinding a workpiece, in particular cams, and to a method for grinding a workpiece, in particular cams, on a holder.

2. Description of Related Art

Grinding machines of this type are known, for example, from the brochure "CamGrind—Produktionslösungen für das Schleifen von Nockenwellen" [CamGrind—Production Solutions for the Grinding of Camshafts] from Studer Schaudt GmbH, Stuttgart, dated October 2006. In this publication, for example, the models "CamGrind S" and "CamGrind L" have grinding devices which consist of a large grinding wheel and of a small grinding wheel and are designed in particular for grinding camshafts. With the large grinding wheel, first of all the cams are pre-ground and the bearing seats machined with high productive capacity while the small grinding wheel serves to finish grind the cam shapes or also to grind the bearing seats. For the machining of the camshaft, said camshaft is arranged on a workholding device which has a work headstock on one side, said work headstock setting the camshaft in the desired rotation about the longitudinal axis thereof, and a tailstock on the other side, said tailstock ensuring that the camshaft is always oriented and centered during the machining. Compared with said, as a rule stationary, components of the workholding device, the grinding wheels or the corresponding grinding spindles are movable relative to the camshaft within the x-z plane.

Where the axes or directions x and z are referred to above or below, this always means the two axes which define the plane which forms the machine bed. In this case, the z-axis extends parallel to the longitudinal extent of the workpiece, here, for example, the camshaft, and the x-axis extends as an axis perpendicular thereto, which therefore corresponds to a movement of a tool towards or away from the corresponding workpiece from the side. Furthermore, the direction perpendicular to the x- and z-axes is designated as the y-axis or y-direction. It consequently runs perpendicularly to the machine bed.

The grinding of the cams directly on the shaft is carried out for the purpose of accuracy so that the cams are formed exactly with respect to the shaft. Compared with said established method, however, the grinding of individual cams is also being increasingly used, since manufacturers of camshafts have in the meantime been successful in being able to join the individual cams to a shaft in a very exact manner. In this case, the exact grinding of the individual cams takes place individually or as groups of a plurality of cams which are usually machined on a work fixture, as a rule a mounting arbor, in a grinding machine.

In the grinding and machining operations with the known grinding machines mentioned at the beginning, burr always accumulates along edges of the ground workpiece, for example, the cams. Said burr is basically undesirable for further use of the ground workpieces, and therefore said burr is removed in separate installations, for example high-pressure deburring installations or brushing stations. For this purpose, the ground device is removed from the grinding machine and inserted into said separate installations such that the workpieces can be further machined there. This therefore has the consequence of an additional machining step with additional machining time and repeated clamping of the workpiece, and, furthermore, has the disadvantage that a separate, further device/machine has to be purchased and provided for production purpose. In addition to the space requirement associated therewith, this also has a negative effect on the economic aspects of the production, since, in addition to additional maintenance and service costs, separate installations of this type also have relatively high capital costs.

SUMMARY

It is an object of the present invention to provide a grinding machine for grinding a workpiece and a method for grinding a workpiece, in which either the formation of burrs is avoided or deburring is made possible within the same grinding machine during or after the grinding operation.

According to an aspect of the present invention, a grinding machine for grinding a workpiece, in particular cams is provided, with a machine bed, a grinding wheel which has a profile with a grinding region running substantially parallel to the axis of rotation of the grinding wheel and at least one profile section which does not run parallel to the axis of rotation of the grinding wheel, a grinding spindle on which the at least one grinding wheel is arranged and which is arranged movably on the machine bed, a control unit for controlling the grinding process, wherein the control unit is configured in such a manner that, with reference to position information on positions of edges of the workpiece in the direction of the longitudinal axis of the workpiece, the edges of the workpiece are successively deburred or chamfered by the at least one profile section of the grinding wheel during or after the grinding of the workpiece, in particular toward the end of the grinding of the workpiece.

The combination of the profiled grinding wheels according to the invention with the control unit according to the invention has the advantage that, during the grinding operation, preferably toward the end of said grinding operation, the corresponding oblique profile section, which does not run parallel to the axis of rotation of the grinding wheel, reaches the edge of the ground workpiece and, depending on the positioning of the grinding wheel, mechanically removes the burr from said edge or else chamfers the edge of the workpiece. In order to make this possible, the positions of the workpieces and the edges thereof are precisely ascertained beforehand such that the alignment of the grinding wheels along the workpieces can be set optimally for said deburring or chamfering steps.

This makes it possible for the workpiece to be received in this grinding machine according to the invention in the form of a product ready for packaging. An additional transfer into a further deburring device is not necessary. This device also makes it possible already to carry out the deburring in the final sections of the grinding process, and therefore the loss of time due to the deburring is further minimized. In this case, it is then no longer necessary to introduce an extra deburring step, since this is already part of the overall grinding process.

In a further refinement of the invention, the grinding wheel has a roof profile with two profile sections which do not run parallel to the axis of rotation of the grinding wheel and between which a grinding region running substantially parallel to the axis of rotation of the grinding wheel is arranged.

The expression "roof profile" refers in this case to a depression which can be recognized in the grinding material in the cross section of a grinding wheel which intersects the grinding wheel in a plane which contains both the axis of rotation thereof and a radius. Said depression runs in such a manner that, as viewed from one edge of the grinding wheel parallel to the axis of rotation in the direction of the other edge of the grinding wheel, there is in each case a larger radius of the grinding wheel at the front and the rear than in a region lying inbetween, said regions being connected to one another by a transition which does not run parallel to the axis of rotation of the grinding wheel, and therefore the resulting cross-sectional profile resembles the shape of a roof.

The provision of the grinding wheel with two profile sections which do not run parallel to the axis of rotation of the grinding wheel, thus producing the shape of a roof profile in cross section, has the advantage that therefore two, in particular outer, edges of a workpiece, in particular cams, can be deburred or chamfered. For this purpose, different displacement positions of the grinding wheels along the z-axis are necessary such that it is possible for the first edge of the workpiece to be machined in one displacement position and for the second edge of the workpiece to be machined in a second displacement position. For this purpose, the control unit is configured in such a manner that it sets both the one and the other displacement position for the grinding wheel with reference to the position information on the positions of the edges of the workpiece. By means of the grinding wheels with the roof profile and with the control unit according to the invention, both the grinding of a workpiece, in particular a cam, and the deburring or chamfering of two edges of a workpiece can be carried out in one grinding process.

In a further refinement of the invention, the at least one profile section is designed in such a manner that the distance from the axis of rotation of the grinding wheel of every point in the profile is reduced along the extent of the profile section toward the apex point. This refinement has the advantage that the grinding region of the grinding wheel, which grinding region is generally arranged in the central region, lies closer to the axis of rotation than the outer edges of the at least one profile section, and therefore, upon moving of the grinding wheel in the direction of the z-axis while simultaneously maintaining contact of the grinding region with the workpiece, the at least one profile section ultimately comes into contact with the edge of the workpiece to be ground. As a result, this at least one profile section can then remove burr which is correspondingly present and/or can chamfer the available edge of the workpiece.

In a further refinement of the invention, the grinding machine has a data input for receiving the position information. The provision by the grinding machine of a data input for receiving the position information has the advantage that it is therefore possible to directly transmit the determined position data of the workpieces into the grinding machine where said position data are then automatically available to the control unit. A complicated inputting or transmitting of the data in another way is therefore not necessary, thus permitting a greater throughput rate and automation.

In a further refinement of the invention, the grinding machine has a measuring device for determining the position information. This has the advantage that the workpieces to be machined do not additionally have to be transferred into a separate device in order to be measured there, whereupon the data then have to be adapted and transmitted. The measuring device is accordingly also adapted to the spatial conditions within the grinding machine and makes it possible to ascertain the corresponding positions in a form suitable therefor.

In a further refinement of the invention, the measuring device is configured for determining the position information contactlessly, in particular by distance analysis by means of laser or an initiator. This has the advantage that said position or distance determination proceeds comparatively rapidly. By contrast, mechanical scanning of the workpieces would be very slow. It is thus possible, for example, for a laser to determine all of the necessary position data, by simple, rapid moving overall scanning of the workpieces to be machined, in the subsecond range.

In a further refinement of the invention, the workpieces are held on a holder, and the measuring device is configured for determining at least a first position relative to a longitudinal stop of the holder of the workpieces. This is advantageous to the effect that there is always a fixed mechanical reference by which the workpiece or the workpiece holder can be aligned upon clamping into the grinding machine. For this purpose, said longitudinal stop is positioned, for example, at a fixed, mechanically predetermined location in the grinding machine, thus making it possible to see, in consequence, the determined positions and the distance from said fixed mechanical stop in the machine. A further ascertaining of the position of the workpieces within the grinding machine in addition to the relative position data is superfluous, which also further simplifies the grinding process.

In a further refinement of the invention, the measuring device is configured for determining all of the positions relative to the longitudinal stop of the holder of the workpieces. This ascertaining of the position has the advantage, for the grinding process, that the control unit according to the invention thus has absolute data on all of the workpieces, and therefore each workpiece can be delivered individually, which increases the flexibility of the grinding machine according to the invention in the form of the possible grinding processes thereof.

In an alternative refinement, the measuring device is configured for determining the remaining positions relative to one another. The relative position information is advantageous for the grinding process of the grinding machine according to the invention when the control unit according to the invention activates the grinding machine or the corresponding grinding wheels in such a manner than the workpieces are to be machined successively. For this purpose, the grinding machine then only requires data concerning how the grinding machine moves from one workpiece to the next. No further calculations are necessary here, and therefore the grinding wheels or grinding spindles can simply be displaced with reference to the position data in the form of relative information.

In a further refinement of the invention, the measuring device is arranged outside an interior space of the grinding machine. The arrangement in particular as a separate device away from the grinding devices has the advantage that the measuring operation for determining the position information can take place as a time-neutral element during the entire grinding process sequence. This is because the measuring or the determining of the position information of a workpiece, for example, a camshaft, can take place at the same time as a continuing grinding operation within the grinding machine. If the grinding operation is then finished, the workpiece which has in the meantime already been measured can then be directly inserted into the grinding machine which is now ready again and can be ground and machined with reference to the position information determined in parallel. There is therefore no non-productive time, in which the grinding machine cannot be operated because the workpieces are being measured.

In another refinement of the invention, the measuring device is arranged within an interior space of the grinding machine. This has the advantage that there is therefore no additional space requirement outside the machine. Both the measuring device and the grinding machine are arranged in a space in the grinding machine, wherein the measuring device in particular determines the position information on a workpiece which is already clamped in the grinding machine. This minimizes the errors which may occur during the transfer of the workpieces from an external measuring device into the grinding machine since the position information relates here directly to the position within the grinding machine and are not relative details for a certain section of the workpiece that, for example in the event of erroneous insertion into the grinding machine, may result in wrong positions.

In a further refinement of the invention, the control unit is configured in such a manner that the edges of the workpiece are deburred or chamfered by the at least one profile section of the grinding wheel only after 50 to 95%, in particular after 60 to 80%, of the entire machining time. The advantage of this refinement of the control unit according to the invention resides in the fact that the general grinding operation can thus first of all take place with the grinding region of the grinding wheel without having an additional interaction between the obliquely running profile sections and the workpiece. Such an interaction mainly also signifies a greater loading for the corresponding, obliquely running profile sections and, consequently, a greater abrasion of material and wear at the grinding wheel. Since the arranging of the at least one profile section at the edge of the workpiece to be ground in particular involves removing burr which has been produced, or chamfering said edge, a relatively short contact between the at least one profile section and the corresponding edge of the workpiece is therefore sufficient.

Accordingly, in the preferred refinement of the grinding wheel with the roof profile, the workpiece is preferably first of all positioned in the central region of the grinding wheel, i.e. in the grinding region, without there being an interaction between the obliquely running profile sections and the edges. The deburring or chamfering step therefore advantageously takes place only toward the end of the entire grinding process. However, it still remains part of the normal grinding operation, since the grinding region continues to remain in contact with the workpiece.

In another aspect of the present invention a method for grinding a workpiece, in particular cams, on a holder with a grinding machine according to the present invention is provided.

This method contains the following steps according to the invention:

a) determining the position of the at least one workpiece on the holder,
b) relaying the position information to a control unit for controlling the grinding process,
c) positioning the grinding wheel for a grinding operation in the direction of the longitudinal axis of the holder of the at least one workpiece and perpendicularly to said longitudinal axis on the basis of the position information,
d) grinding the at least one workpiece with the grinding region of the grinding wheel,
e) moving the grinding wheel in the direction of the longitudinal axis of the holder of the at least one workpiece on the basis of the position information such that a profile section of the grinding wheel, which profile section does not run parallel to the axis of rotation of the grinding wheel deburrs or chamfers an edge of the workpiece.

In a preferred refinement of said method according to the invention, said method also contains the following further step:

(f) moving the grinding wheel in the opposite direction to the longitudinal axis of the holder of the at least one workpiece on the basis of the position information such that another profile section of the grinding wheel, which profile section does not run parallel to the axis of rotation of the grinding wheel, deburrs or chamfers a further edge of the workpiece.

Said method makes it possible to optimally use the grinding machine according to the invention that is mentioned at the beginning. For this purpose, the position of the workpieces has to be exactly ascertained. With the aid of said position information, the grinding wheels are then directly activated such that the latter are optimally aligned for the general grinding operation and, toward the end of the grinding operation of a workpiece, are moved in the direction of the longitudinal axis of the holder of the at least one workpiece, i.e. in the direction of the z-axis, in such a manner that the oblique profile sections deburr or chamfer one edge of the workpiece and preferably also a further edge thereof.

According to the explanations provided at the beginning, this has the significant advantage that the deburring or chamfering can take place within one and the same machine and, furthermore, even takes place in time as a final measure within the actual grinding operation. Thus, ultimately not only is time saved as a result of the fact that the workpiece does not have to be transferred into a further machine, but also as a result of the fact that the deburring or chamfering step proceeds as part of the actual grinding operation. In other words, virtually the entire time for an additional deburring or chamfering step is therefore dispensed with. This therefore has a positive effect on the production time and costs and on the economy of the method as a whole.

It goes without saying that the features mentioned above and those which have yet to be explained below can be used not only in the respectively stated combination but also in other combinations or on their own without departing from the scope of the present invention.

BRIEF DESCRIPTION OF THE DRAWINGS

The invention is described and explained in more detail below with reference to selected exemplary embodiments in conjunction with the attached drawings, in which.

DESCRIPTION OF THE EMBODIMENTS

Figure 1:
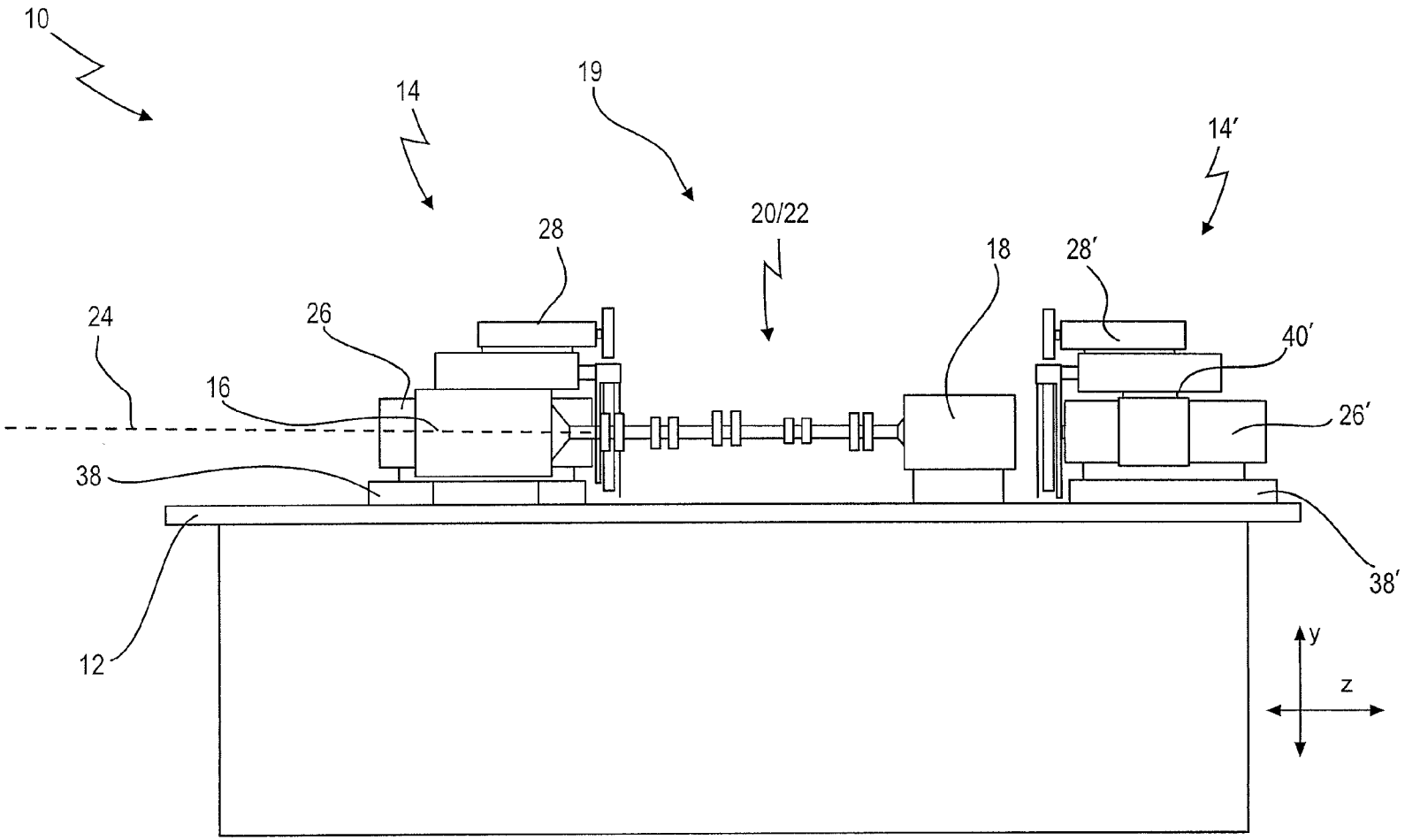
FIG. 1 shows a grinding machine according to the invention in the entirety thereof as a side view.

A grinding machine which is described in more detail below is designated overall below by the reference number 10. It can be seen in FIG. 1 that the grinding machine 10 has a machine bed 12, two grinding spindle sets 14 and 14', and a work headstock 16 and a tailstock 18, which are arranged in an interior space 19. A workpiece 20 in the form of a camshaft 22 is clamped between the work headstock 16 and tailstock 18.

Said camshaft 22, or in general the workpiece 20, can be rotated about the longitudinal axis 24 thereof by the work headstock 16 and tailstock 18 and, during said movement, is machined or ground according to generally known methods by the grinding spindle sets 14 and 14' which are movable laterally along the x- and z-axis.

In the present case, the grinding spindle sets 14 and 14' are both of identical construction. The respective construction thereof is illustrated by way of example in FIG. 2 with reference to the grinding spindle set 14, but this applies correspondingly to the grinding spindle set 14'.

Owing to the identical construction of the grinding spindle set 14 and grinding spindle set 14', the same reference numbers merely differentiated in each case by a prime are used for the components of both. Accordingly, even if not explicitly mentioned each time, the features for a component of the grinding spindle set 14 also apply to the corresponding component of the other grinding spindle set 14' and vice versa, unless otherwise stated.

The grinding spindle set 14 consists of a first grinding spindle 26 and a second grinding spindle 28, which in this case is smaller. Said grinding spindles respectively consist of a spindle block 30 and 32 and of a grinding wheel 34 and 36, each arranged on grinding wheel fixtures 35 and 37 of the grinding spindles 26 and 28. In the present case, owing to the size ratios, the grinding wheel 34 is configured as a large grinding wheel and the grinding wheel 36 is configured as a comparatively small grinding wheel.

Of course, despite said selected size ratios, other size ratios are also conceivable, and therefore the grinding spindle 28 with the grinding wheel 36 may be configured to be larger than or the same size as the grinding spindle 26 with the grinding wheel 34.

Figure 2:
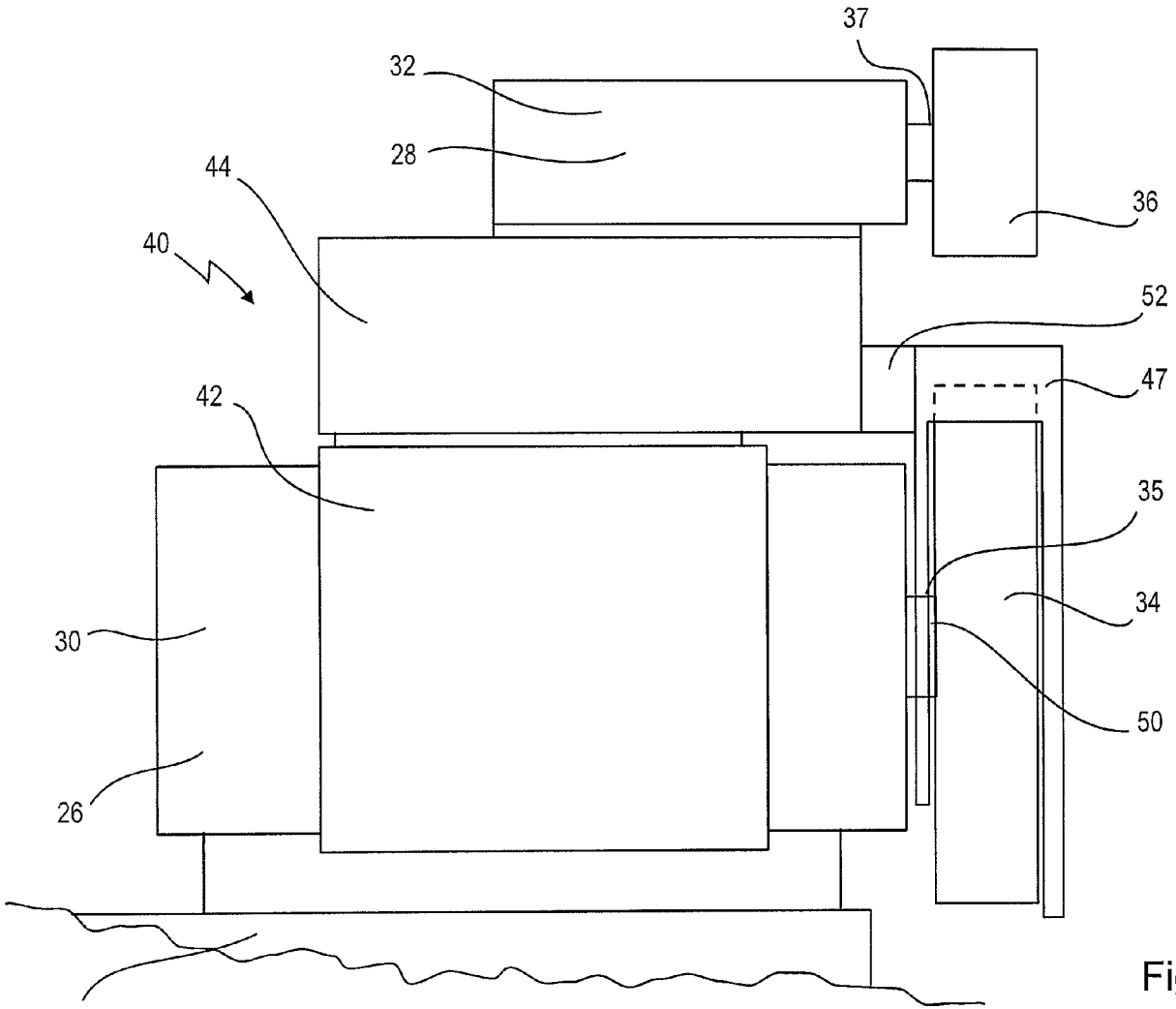
FIG. 2 shows a detailed view of a grinding spindle set according to the invention of the grinding machine from FIG. 1.

The grinding spindle 28 is aligned with respect to the grinding spindle 26 in such a manner that the grinding wheels 36 and 34 come to lie one above the other, according to the view of FIG. 2, which is expressed in respect of the entire grinding machine 10 in such a manner that the two grinding wheels 34 and 36 come to lie within a plane which runs perpendicularly to a direction of the z-axis. The grinding spindles 26 and 26' are arranged on a slide 38 and 38', not shown in FIG. 2 but visible in FIG. 1, and are movable thereon independently of each other in the x- and z-directions on the machine bed 12. The grinding spindles 28 and 28' are arranged via a support 40 on the grinding spindles 26 and 26', in the case illustrated on the spindle blocks 30 and 30' thereof. As can be seen in FIG. 2, in this case, said support 40 has a sleeve 42 and a holder 44. The holder 44 serves to directly receive and fasten the grinding spindle 28 and therefore to arrange the latter on the sleeve 42. The sleeve 42 is configured in a manner corresponding to the spindle block 30 of the grinding spindle 26, and is arranged on said spindle block and mounted pivotably about an axis of rotation 46 of the grinding spindle 26.

Owing to this configuration, it is possible to pivot the grinding spindle 28 with the grinding wheel 36 about the axis of rotation 46 of the grinding spindle 26 via the sleeve 42 and the holder 44. Said pivoting is carried out by means of a drive unit (not shown specifically here) which can be selected, configured and arranged to the knowledge of a person skilled in the art in this field of grinding machines in order to obtain a desired functionality of said pivoting capability. By way of example, pneumatic and hydraulic drives or else drives via gearwheels or belts should be mentioned at this juncture.

In order to protect the grinding wheel 34, the latter, as can be seen in particular in FIG. 2, is provided with a protective flap 47. Said protective flap 47 is arranged in the position shown in FIG. 2 such that it releases that region of the grinding wheel 34 which faces the observer, and therefore a workpiece which is located on this side facing the observer can be ground.

The protective flap 47 can likewise be pivoted and rotated about the axis of rotation 46 by being mounted rotatably on a shaft 50. In order to simultaneously pivot the grinding spindle 28 and the protective flap 47, the latter is connected via a web 52 to the support 40, in particular to the holder 44 in the present exemplary embodiment. By means of this operative connection, during a pivoting movement of the grinding spindle 28 about the axis of rotation 46 of the grinding spindle 26, the protective flap 47 is likewise pivoted at the same time such that that region of the grinding wheel 34 which faces the observer in FIG. 2 is now covered by the protective flap 47. This can be seen by way of example in the top view of FIG. 3.

Figure 3:
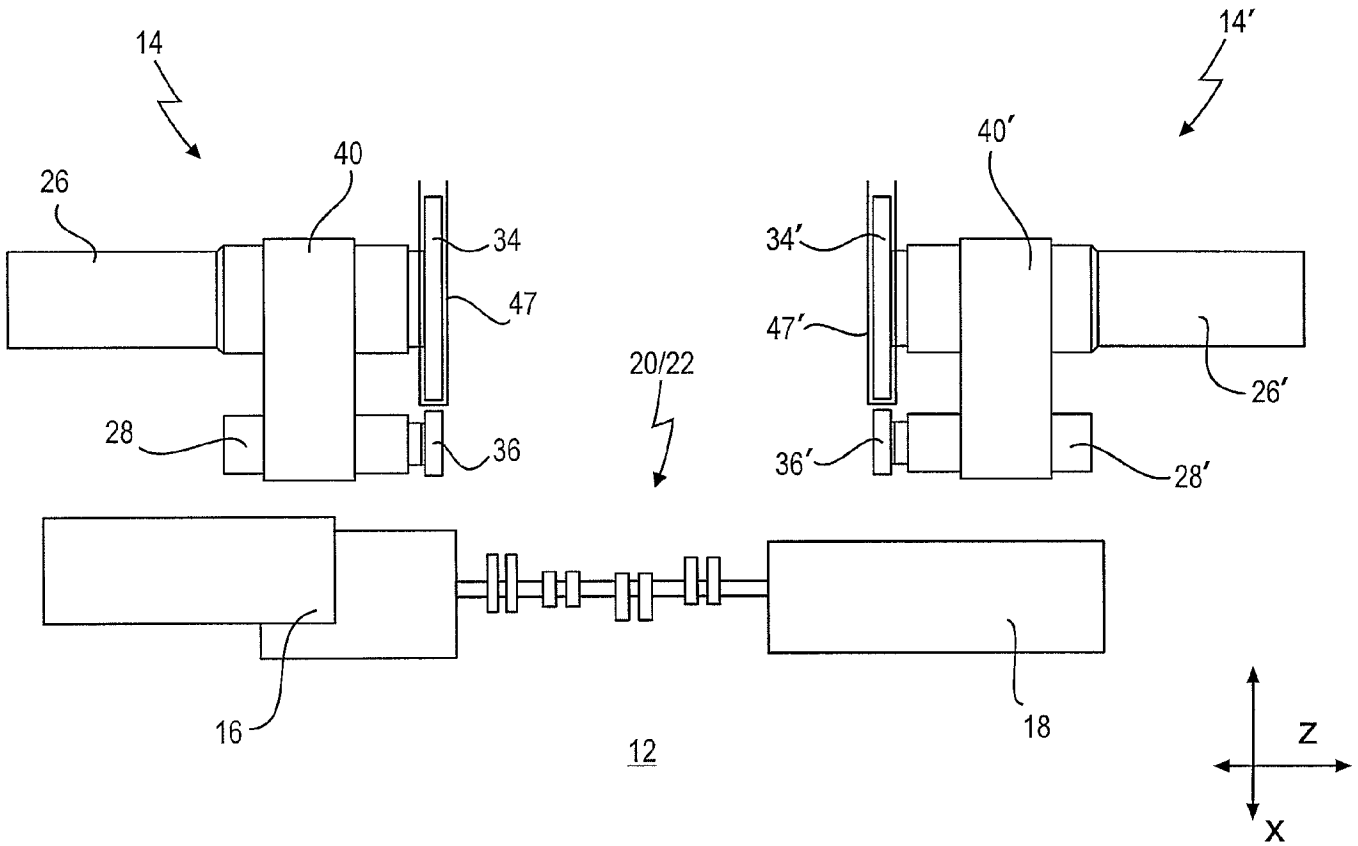
FIG. 3 shows a grinding machine according to the invention in a top view.

It can also be seen in the view of FIG. 3 how the grinding spindle 28 is positioned within the entire grinding machine 10 after the pivoting operation. Whereas, in the view of FIG. 1, the position of the grinding spindle 26 and grinding spindle 28 is such that the grinding wheel 34 of the grinding spindle 26 is arranged freely for machining and grinding the workpieces 20, in the position illustrated in FIG. 3 the grinding wheel 36 of the grinding spindle 28 is located between the workpiece 20 and the larger grinding wheel 34 of the grinding spindle 26 with respect to the direction of the x-axis. Accordingly, the grinding wheel 36 of the grinding spindle 28 is arranged in such a manner that it can be used for machining and grinding the workpiece 20, here the camshaft 22.

This arrangement of a large grinding wheel 34 for pre-grinding a camshaft 22 and of a small grinding spindle 28 with the grinding wheel 36 which small grinding spindle is arranged pivotably on the grinding spindle 26 of the large grinding wheel 34, has the advantage that a significant saving in space is obtained by means of this combination. The advantages arising by means of the arrangement of the grinding wheels 36 and 34 within the previously mentioned common spindle plane, which runs perpendicularly to a direction of the z-axis, will be described in more detail below.

Figure 4A:
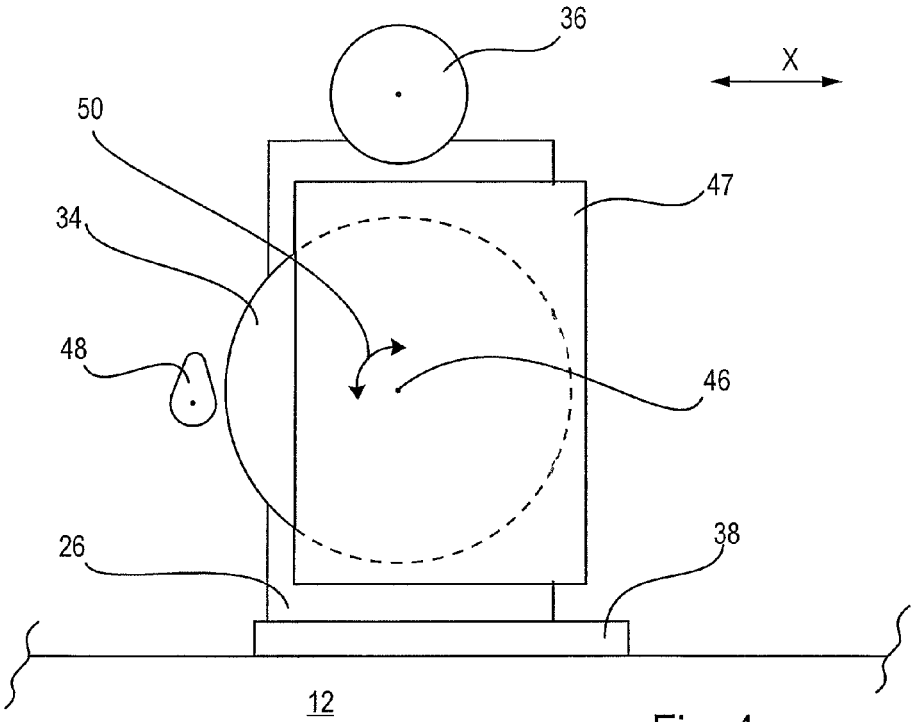
FIGS. 4*a* and 4*b* show a side view of a grinding spindle set according to the invention with the grinding spindle positions which differ in each case.
Figure 4B:
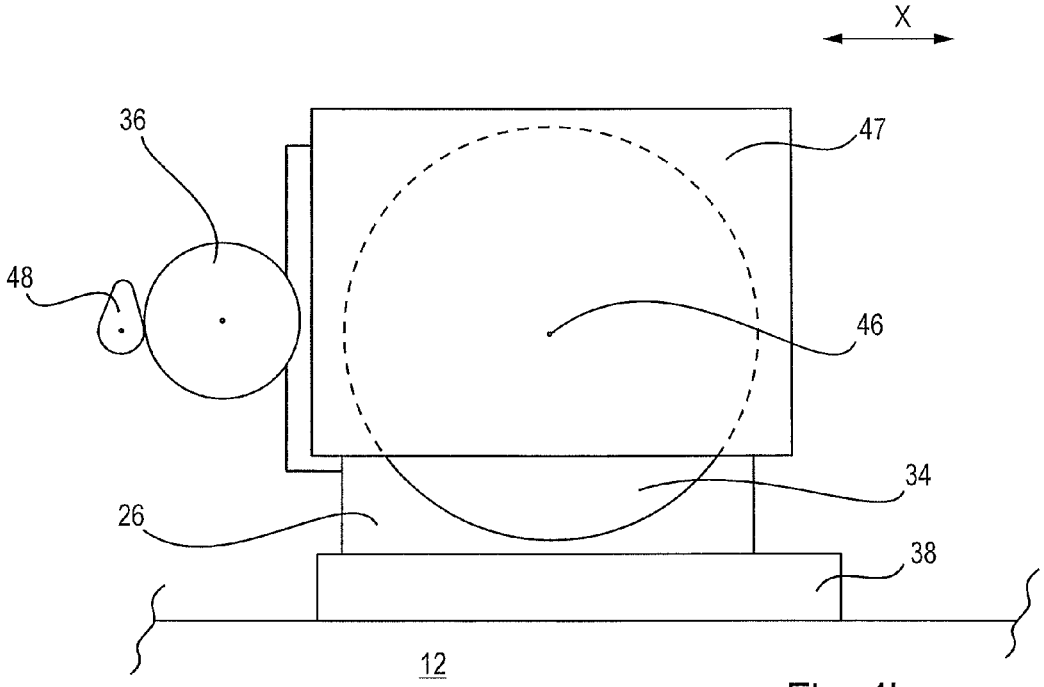

FIGS. 4*a* and 4*b* once again clarify the principle of the pivotable small grinding wheel 36 in relation to the large grinding wheel 34. FIG. 4*a* shows the state which is also shown in FIG. 1 and FIG. 2 and in which the small grinding wheel 36 with the grinding spindle 28 is arranged above the large grinding wheel 34, with respect to the views of FIGS. 1, 2 and 4*a* and 4*b*. In this case, the large grinding wheel 34 is covered in the right region illustrated in FIG. 4*a* by the protective flap 47, but is released in the left region such that workpieces, here, for example, a cam 48 of a camshaft 22, can be ground. If said pre-grinding with the large grinding wheel 34 is finished, the grinding spindle set correspondingly moved in the x-direction by the slide 38 and subsequently a rotation about the axis of rotation 46 of the grinding spindle 26 can take place, as indicated here by the double arrow 50.

This rotation ends in the position (illustrated in FIG. 4) of the small grinding wheel 36 and the grinding spindle 28 (not shown specifically here) in a position which, according to the illustration of FIG. 4*b*, is on the left next to the large grinding wheel 34. In this exemplary embodiment, by rotation of the grinding spindle 28 with the small grinding wheel 36, the protective flap 47 is also rotated, as has already been described previously, and therefore that region of the large grinding wheel 34 which faces the workpiece 20 is now covered or protected by the protective flap 47. The small grinding wheel 36 can now carry out the finish grinding of the cam 48 while the large grinding wheel 34 cannot be damaged by abrasion or splitter materials.

If the large grinding wheel 34 is intended to be used again for grinding operations, the small grinding wheel 36 with the grinding spindle 28 may, of course, be pivoted back again in a reverse manner corresponding to what has been stated above such that again, according to the pivoting movement, indicated by the double arrow 50, the small grinding wheel 36 takes up a position above the large grinding wheel 34, as illustrated in FIG. 4*a*.

Figure 10A:
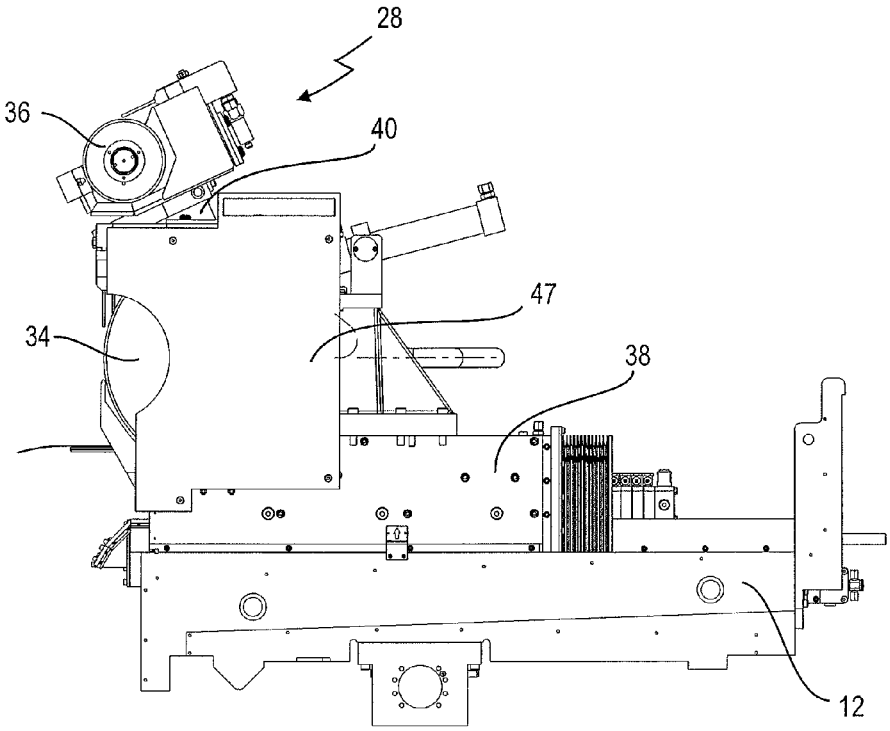
FIGS. 10*a* and 10*b* show a further side view of a grinding spindle set according to the invention with the grinding spindles each in different positions.
Figure 10B:
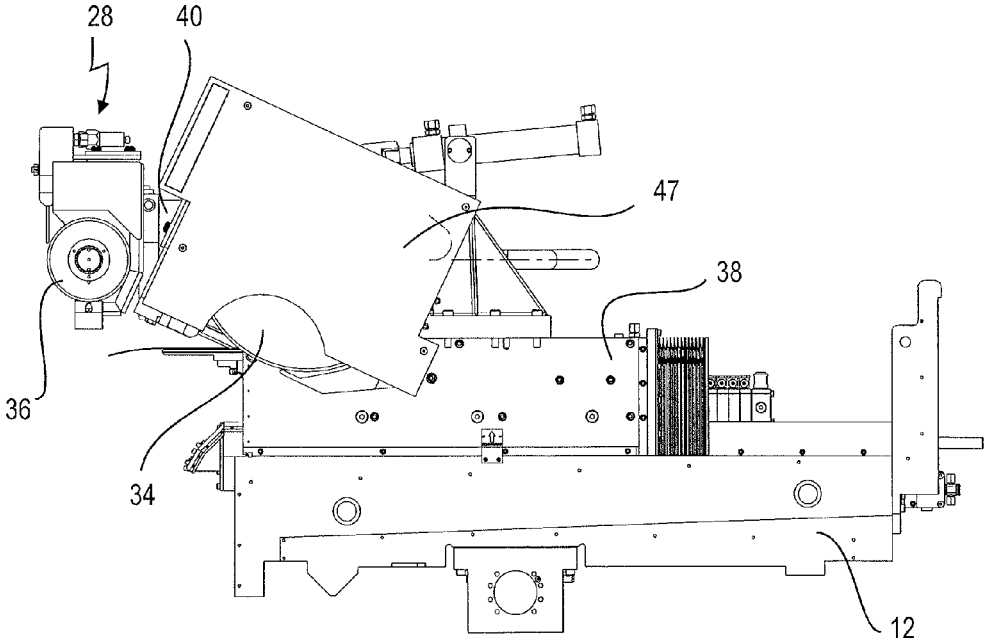

FIGS. 10*a* and 10*b* likewise illustrate an embodiment of the grinding machine 10 according to FIGS. 4*a* and 4*b*. In this case, the grinding wheels 34 and 36 and the protective flap 47 can in particular also be seen in the respective positions thereof before and after the pivoting of the grinding spindle 28.

Figure 5:
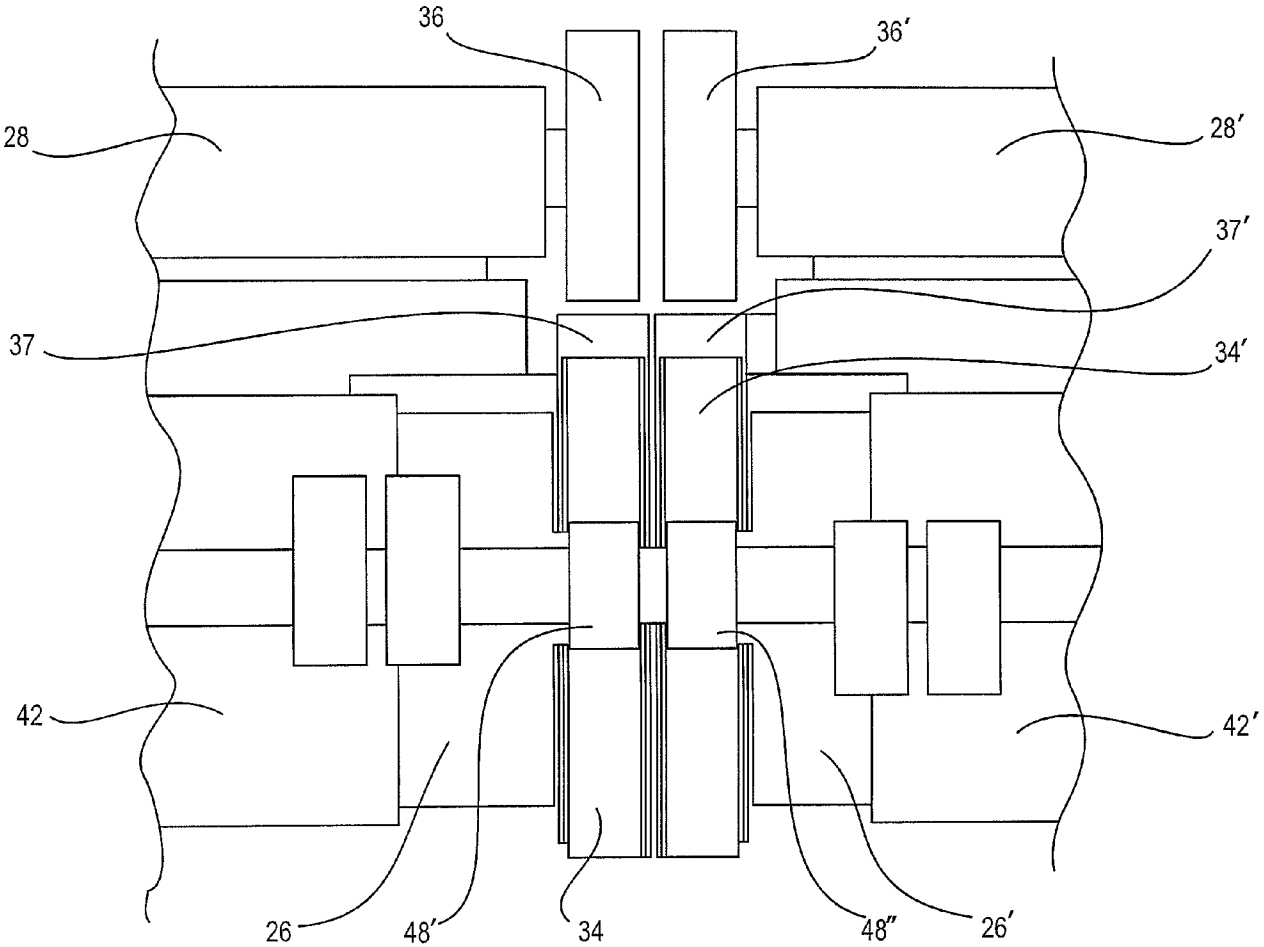
FIG. 5 shows a cutaway detailed view of the grinding machine according to the invention from FIGS. 1 and 3 in a side view with a grinding spindle set positioning suitable for the pre-grinding of the workpieces.

As has already been mentioned at the beginning, the grinding machine according to the invention is suitable in particular for simultaneously grinding or machining workpieces arranged closely adjacent on a holder, for example, in the exemplary embodiments illustrated here in FIG. 5 et seq., the cams 48' and 48" on the camshaft 22. In this case, each of the cams 48' and 48" is machined by a respective grinding spindle set 14 and 14'.

To this end, the exemplary embodiment of FIG. 5 illustrates the positioning of the grinding spindle sets, in which the cams 48' and 48" are pre-ground on the camshaft 22 with the large grinding wheels 34, 34'. For this purpose, the grinding spindle sets are brought together in the direction of the z-axis and are aligned in each case with the height of a cam 48', 48" in such a manner that the large grinding wheels 34, 34' are each opposite one of said cams 48' and 48" with respect to the direction of the z-axis. It goes without saying that, subsequently or simultaneously, an alignment is also carried out with respect to the x-axis so that the grinding wheels 34, 34' can come into corresponding contact with the cams 48', 48" in order thereby to be able to carry out a grinding process corresponding to the known methods. The corresponding alignments within the direction of the x-axis for adaptation to the shape of the workpieces, here the cams 48, during rotation of the camshaft 22 about the longitudinal axis 24 thereof, also take place in accordance with the generally known methods and with corresponding parameters.

During this process of pre-grinding the cams 48' and 48", the large grinding wheels 34 and 34' can move towards each other apart from a few mm in the direction of the z-axis. As a result, simultaneous pre-grinding of said pair of cams 52, which is formed from the cams 48' and 48", is made possible. In the case of the abovementioned moving together in the direction of the z-axis, the minimum distance between the two grinding wheels 34 and 34' is predetermined merely by the width of the protection flaps 47 and 47'.

If the pre-grinding operation by the large grinding wheels 34 and 34' is ended, the grinding spindle sets 14 and 14' can be spaced apart from the camshaft 22 in the direction of the x-axis, whereupon the grinding spindles 28 and 28' are pivoted with the small grinding wheels 36 and 36', according to the explanations provided above, about the axes of rotation 46 and 46' of the grinding spindles 26 and 26' such that the grinding wheels 36 and 36' come to lie at a height above the machine bed or are correspondingly spaced apart therefrom, and therefore the grinding wheels 36 and 36' can now be used for machining the workpieces 20, i.e. the cams 48' and 48" here.

In this case too, the grinding spindle sets 14 and 14', therefore also the grinding wheels 36 and 36', are again correspondingly aligned in the direction of the z-axis and therefore said grinding wheels 36 and 36' come to lie relatively close to each other in order to be able further to process or grind a corresponding pair of cams 52, here the cams 48' and 48". This positioning is clarified in FIG. 6.

Figure 6:
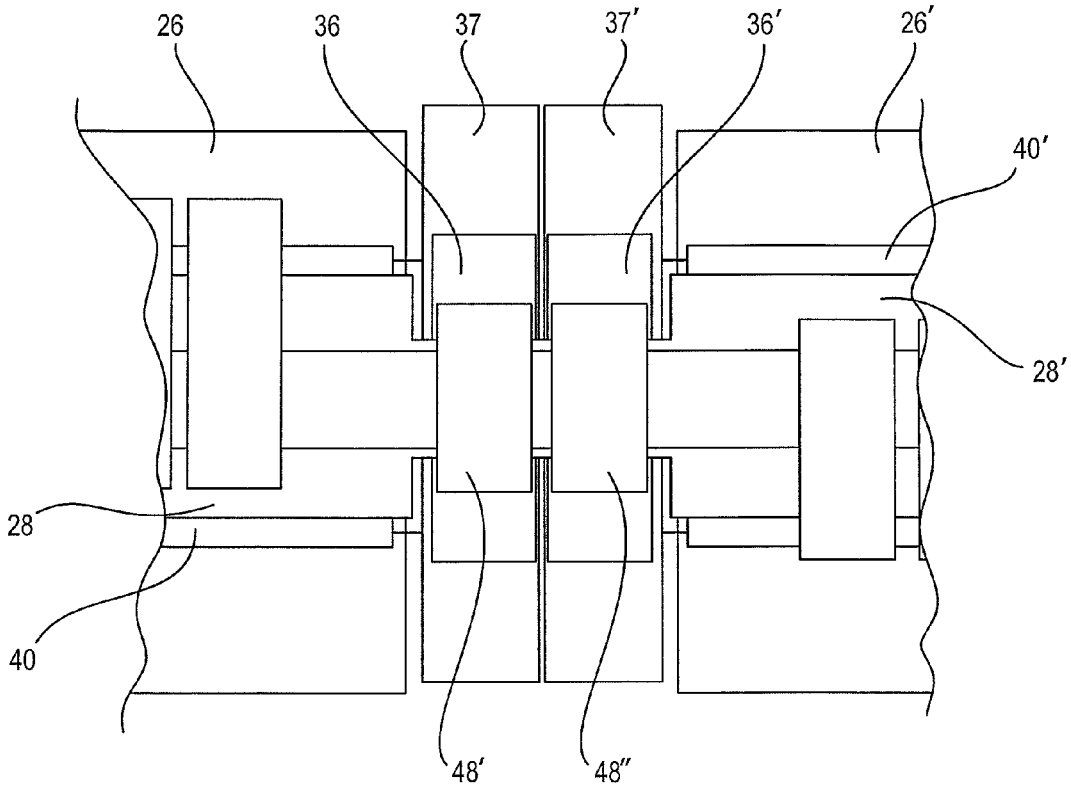
FIG. 6 shows a cutaway detailed view according to FIG. 5 with a grinding spindle set positioning suitable for the finish grinding of the workpieces.

It is seen here that, from the view of the observer in FIG. 6, the small grinding wheels 36 and 36' come to lie behind the cams 48' and 48" and, therebehind in turn, the protection flaps 47 and 47', which cover and protect the grinding wheels 34 and 34', can be seen. Furthermore, it is also apparent that, unlike in the illustration of FIG. 5, the grinding spindles 28 and 28' no longer come to lie above the grinding spindles 26 and 26' but rather are arranged between the camshaft 22 and the grinding spindles 26 and 26'.

By means of this arrangement between the camshaft 22 and the grinding spindles 26 and 26', and with the grinding wheels 36 and 36' in a plane parallel to the direction of the z-axis together with the corresponding large grinding wheels 34 and 34', it is also possible here to simultaneously machine a pair of cams 52.

It goes without saying that the grinding spindle sets 14 and 14' are also aligned here in the direction of the x-axis in accordance with known methods and with corresponding parameters in such a manner that the grinding wheels 36 and 36' also always have the necessary and desired contact with the workpieces 20, here the cams 48' and 48", so that successful machining and grinding are achieved.

In addition to the exemplary embodiments illustrated here in FIGS. 1 to 6, in which the grinding spindle sets 14 and 14' are arranged and are movable on the machine bed 12 on a common side of the workpiece 20 or of the camshaft 22, it is, of course, also conceivable for the grinding spindle sets 14 and 14' to be arranged movably on different sides of the workpiece 20 or of the camshaft 22 corresponding toe the knowledge of a person skilled in the art in the field of grinding machines of this type. Furthermore, it is also conceivable, despite the simultaneous, common machining of a pair of cams 48', 48" that are shown here in particular in conjunction with FIGS. 5 and 6, that two corresponding cams 48' and 48" or in general workpieces can be machined independently of one another.

Figure 7:
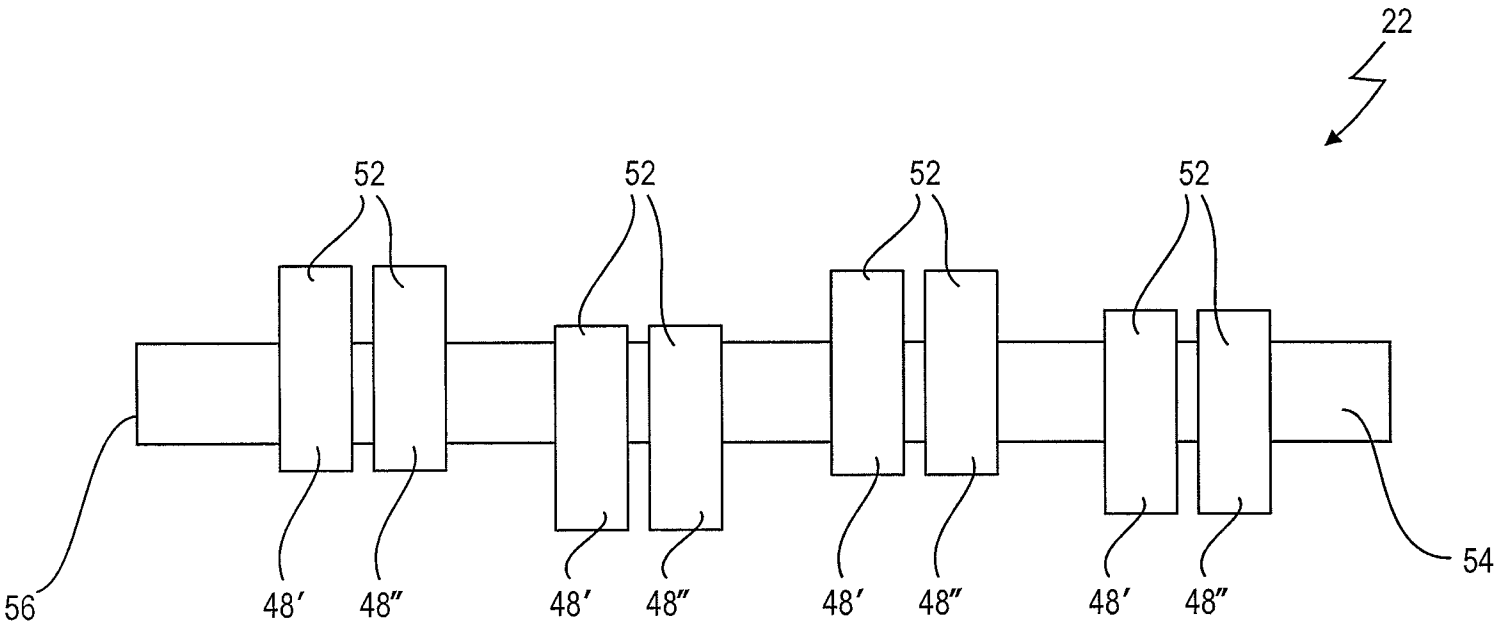
FIG. 7 shows a schematic side view of a camshaft as a workpiece of the grinding machine according to the invention.

FIG. 7 shows the schematic construction of a camshaft 22 with the shaft 54 on which the cams 48 are arranged. Of said cams 48, every two cams 48' and 48" form a pair of cams 52. Said pair of cams is characterized in that the associated cams 48' and 48" lie relatively close to each other, at least closer than the distance of one pair of cams to another pair of cams, and that the corresponding cams 48' and 48" within such a pair of cams 52 are identically arranged and aligned in the arrangement thereof with respect to the rotation about the shaft 54. If said camshaft 22 is inserted into the grinding machine 10, the camshaft 22 is aligned within the grinding machine 10 in such a manner that a longitudinal stop 56, which is inserted, for example, into the work headstock 16, always take up the same position within said grinding machine 10.

This alignment by means of the longitudinal stop 56 can therefore be used to ascertain the position of the cams 48 on the shaft 54 precisely relative to said longitudinal stop 56 up to a few μm. This ascertaining can be carried out so as to determine position information of the cams 48 relating to the longitudinal stop 56 or also such that a corresponding cam 48 is described in the position thereof such that the position information refers to a preceding cam 48 on the shaft 54. For example, the position of a cam 48" from FIG. 7 could be described by the distance from the longitudinal stop 56 or else could be specified as position information with respect to the previous cam 48'.

Figure 9:
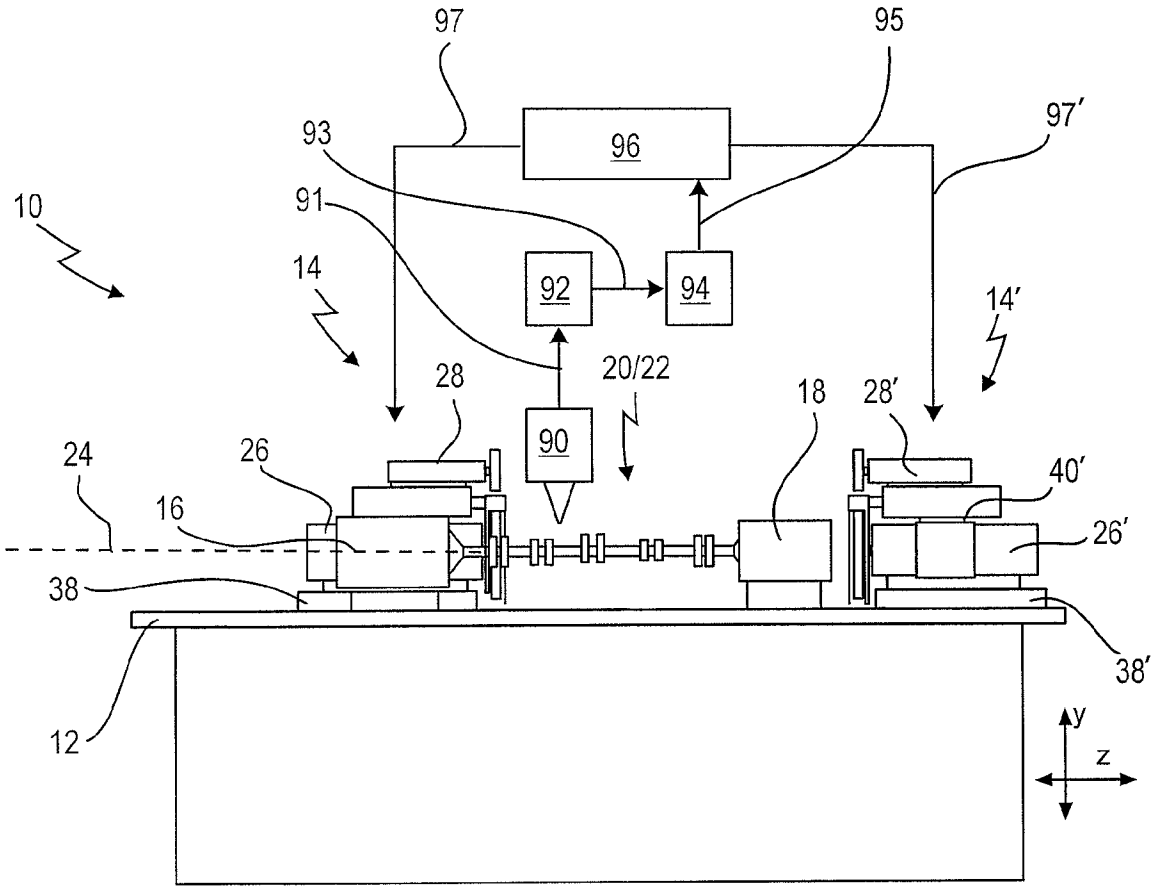
FIG. 9 shows the grinding machine from FIG. 1 with an additional schematic illustration of a measuring device according to the invention, and with a data input and a control unit.

The devices necessary for determining and processing the position information are shown in FIG. 9. The measuring device 90 can be arranged both as a separate device outside the grinding machine 10 and also can be arranged in the interior space 19 of the machine in order there to ascertain the position of the cams 48 directly on the clamped camshaft 22. The former alternative has the advantage that the positions of the cams can be ascertained while the grinding machine 10 is already being operated with another grinding operation. Non-productive times which are caused by the measuring and therefore block the grinding machine 10 for the grinding process are therefore avoided.

By contrast, the other alternative with the arrangement of the measuring device 90 within the grinding machine 10 has the advantage of not requiring any additional space outside the grinding machine 10. In addition, errors which may occur during the clamping of the camshaft 22 into the grinding machine 10 and by means of which displacement of the previously determined position may arise are avoided.

According to the invention, the determining of the position by the measuring device 90 can preferably be carried out by contactless methods, in particular by lasers or initiators. Furthermore, however, other methods of contactless and contacting measurement of the workpieces, for example mechanical scanning methods, that are known to a person skilled in the art in this field, are, of course, also conceivable.

The data determined by the measuring device 90 are relayed to a data input 92 of the grinding machine 10, as indicated schematically by the arrow 91. Then, as indicated schematically by the arrow 93, the data pass from the data input 92 into a data processing means 94 of the grinding machine 10. The data processing means 94 edits the data in accordance with methods known to a person skilled in the art in this field and subsequently supplies said data to a control unit 96, as indicated by the arrow 95. The control unit 96 serves for the direct control of the grinding spindle sets 14 and 14'. This includes both the moving of the grinding spindle sets 14 and 14' on the machine bed 12 and, according to the explanations provided previously, the positioning of the grinding spindles 28 and 28' by pivoting and the operation of the grinding wheels 34, 34', 36 and 36'. The control of the grinding spindle sets 14 and 14' by the control unit 96 is indicated schematically in FIG. 9 by the arrows 97 and 97'. By contrast, the arrows 91, 93 and 95 illustrate the basic course of the position information in accordance with the explanations provided previously.

The ascertaining of the position information on the individual cams 48 of the camshaft 22 is firstly advantageous to the effect that, owing to said position information, the grinding spindle sets 14 and 14' can be aligned by a control unit (not shown specifically here) in such a manner that grinding of the cams 48, as has been indicated, for example, by FIGS. 5 and 6 and described in context thereto, can be carried out. Since the grinding wheels cannot be of arbitrary width because of the close convergence of the grinding wheels 34 and 34' or 36 and 36' within the region of 10 mm, a certain degree of accuracy of the position information is already necessary at this point.

Furthermore, owing to said exact position information, deburring or chamfering of the workpieces 20, here the cams 48, is made possible, as described in more detail below in conjunction with FIGS. 8*a* to 8*c*.

Figure 8A:
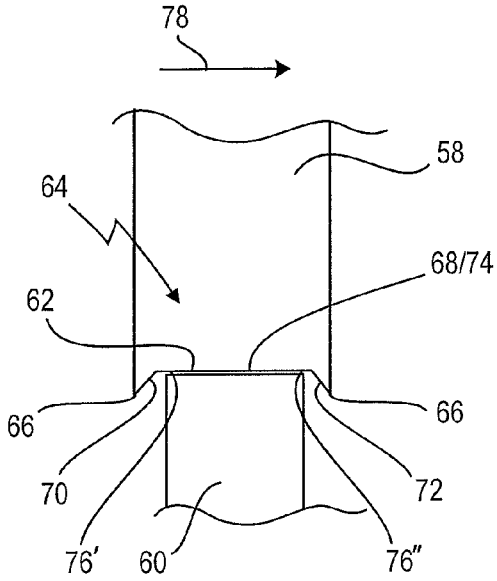
FIGS. 8*a* to 8*c* show cutaway detailed views of different positioning of a small grinding wheel with a roof profile for deburring or chamfering a workpiece.

FIG. 8*a* shows a grinding wheel 58 which constitutes a particular embodiment of the small grinding wheels 36 and 36'. Said grinding wheel 58 is aligned with a workpiece 60, for example a cam 48, for machining thereof. As can be seen in FIGS. 8*a* to 8*c*, the grinding material 62 of said grinding wheel 58 has what is referred to as a roof profile 64. Said roof profile 64 is characterized by a depression in the grinding material 62 in the side facing the workpiece 60. This results in revolving grinding surfaces 66 located further outward and in a revolving grinding surface 68 located further inward with respect to the axis of rotation (not shown specifically here) of the grinding wheel 58. Said grinding surfaces 66 and 68 are connected to each other by oblique profile sections 70 and 72, which are not aligned parallel to the axis of rotation of the grinding wheel 58, as a transition. From this offset between the ends 66 and 68 and from the oblique profile sections 70 and 72, the roof profile 64 which can be seen in the view of FIGS. 8*a* to 8*c* arises.

Said roof profile 64, because of the grinding material 62, therefore has a grinding region 74, which coincides with the inner end 68, and the obliquely running profile sections 70 and 72, which are suitable for deburring and chamfering, as is described in more detail below.

It goes without saying that, in addition to the explanation provided above with respect to the roof profile 64 which can be seen in FIGS. 8*a* to 8*c*, the term "roof profile" here, below and in general within the context of this invention also means and comprises profiles in grinding wheels having only one profile section 70, 72 and also having a grinding region 74 which does not run parallel to the axis of rotation.

If the finished grinding of a workpiece 60, for example a cam 48, is intended to be carried out with such a grinding wheel 58 analogously to the small grinding wheels 36, said grinding wheel 58 is first of all aligned with the workpiece 60 in such a manner that the latter is machined preferably exclusively by the grinding region 74. This positioning is illustrated by way of example in FIG. 8*a*. In order successfully to obtain this alignment, use is made of the position information as described in more detail above.

During the grinding operation with the grinding region 74, a certain amount of burr (not shown specifically here) frequently forms on the edges 76' and 76" of the workpiece 60.

If the grinding wheel 58 is now moved in a direction of the z-axis, illustrated here by way of example by the arrow 78, the transition from the grinding region 74 into the profile section 70 strikes in the region of an apex point 80 against the corresponding burr-effected edge 76' of the workpiece 60. This positioning is illustrated by way of example in FIG. 8*b*. This can take place after the actual grinding process or toward the end of the grinding process, in particular at a time which corresponds approximately to 60 to 100% of the total machining time of the individual workpiece.

Consequently, further grinding with the grinding region 74 therefore takes place at the same time as the deburring or chamfering of the edge 76' by the profile section 70. After the deburring or chamfering operation on the edge 76' is ended, the grinding wheel 58 is moved, as before, in the opposite direction, which is indicated in FIG. 8*b* by the arrow 82. The end position of this movement along the direction of the arrow 82 is the position, which is illustrated in FIG. 8*c*, of the grinding wheel 58 on the workpiece 60, wherein only the edge 76" of the workpiece 60 comes to lie here in the region of the apex point 84 between the grinding region 74 and profile section 72.

Figure 8B:
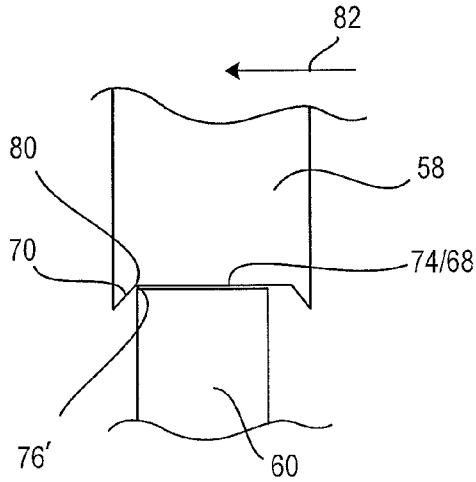
Figure 8C:
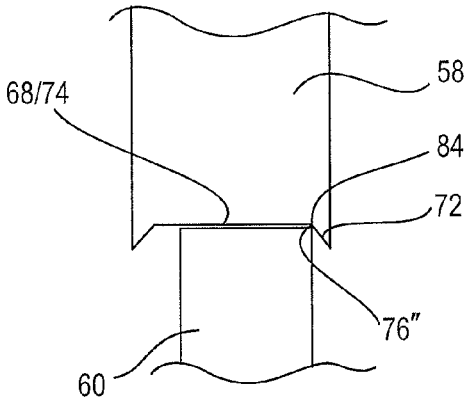

Given this positioning of the grinding wheel 58 on the workpiece 60, then, corresponding to the explanations provided previously in conjunction with FIG. 8*b*, a burr formed on the edge 76" is then analogously removed by the profile section 72 of the grinding wheel 58. Furthermore, the edge 76" of the workpiece 60 is then optionally also chamfered by said profile section 72.

In order to be able to exactly carry out said deburring and/or chamfering, it is necessary for the abovementioned position information on the workpieces 60, i.e. for example, the cams 48, to be present with as high a degree of accuracy as possible, since, firstly, the distances from the apex points 80 and 84 during the actual grinding operation are comparatively small, corresponding to FIG. 8*a*, in order to avoid an unnecessary width of the grinding wheel 58. Secondly, it is often intended for no chamfering of the workpiece 60 at the edges 76' and 76" thereof to be carried out at all, and therefore the profile sections 70 and 72 of the grinding wheel 78 are intended to be arranged on said corresponding edges 76' and 76" of the workpiece 60 precisely in such a manner that the grinding action of the abovementioned profile sections 70 and 72 is precisely sufficient for the deburring of the workpiece 60 at the edges 76' and 76" thereof.

It goes without saying that, despite the explanations provided previously, movement of the grinding wheel 58 in a reverse sequence, i.e. first in the direction of the arrow 82 and then in the direction of the arrow 78, also lies within the context of this invention and leads in an analogous manner to the same results.

According to the explanations provided previously in conjunction with, in particular, FIGS. 8*a* to 8*c* and FIG. 9, a method according to the invention for grinding workpieces 60 of this type, in particular cams 48, proceeds in such a manner that, first of all, the positions of the workpieces 60 on a holder (not shown specifically in FIGS. 8*a* to 8*c*), for example the shaft 54, are determined. This can be understood by a measuring device 90. Said position information is then relayed to the control unit 96 of the grinding machine 10, the control unit controlling the grinding process and therefore also the grinding spindles 26, 26', 28 and 28' of the grinding spindle sets 14 and 14'. If necessary, the position information can also be edited and adapted beforehand by the data processing means 94. On the basis of said position information, said control unit 96 controls, for example, the grinding spindles 28 and 28', and therefore indirectly the grinding wheel 58, or, for example, the grinding wheels 36 and 36', in the direction of the z-axis and also in the direction of the x-axis toward the workpiece 60. As shown in FIG. 8*a*, the workpiece 60 is then first of all ground by the grinding region 74 of the grinding wheel 58, whereupon, corresponding to the explanations provided previously in conjunction with FIGS. 8*b* and 8*c*, the grinding wheel 58 is then moved in the direction of the z-axis, as indicated by the arrows 78 and subsequently 82, in order to deburr or chamfer the edges 76' and 76" of the workpiece 60. The steps of the movement along the z-axis are based, as has already been explained before, on the exact position information ascertained in the first step of determining the position of the workpieces 60.

By means of this method, the deburring and/or chamfering can be carried out in a time-neutral manner in the grinding machine 10, as a result of which an additional step, which generally requires a further machine, for deburring and/or chamfering the workpieces 60, as has been carried out hitherto, is dispensed with.

The invention claimed is:

1. A grinding machine for grinding edges of cams on a camshaft workpiece, comprising:

a machine bed, a grinding wheel which has a profile with a grinding region running substantially parallel to the axis of rotation of the grinding wheel and two oblique profile sections which do not run parallel to the axis of rotation of the grinding wheel, a grinding spindle on which the grinding wheel is arranged and which is arranged movably on the machine bed, a control unit for controlling the grinding wheel and the grinding spindle during a grinding operation, wherein the control unit is configured to move the grinding wheel successively between a plurality of positions in the direction of a longitudinal axis of the camshaft workpiece such that the edges of the cams are successively deburred or chamfered by the two oblique profile sections of the grinding wheel.

2. The grinding machine as claimed in claim 1, wherein the profile of the grinding wheel has a roof profile with the grinding region arranged between the two oblique profile sections.

3. The grinding machine as claimed in claim 1, wherein the profile section is configured such that the distance from the axis of rotation of the grinding wheel to a point on the profile section decreases along an extent of the profile section toward an apex point of the profile section.

4. The grinding machine as claimed in claim 1, wherein the grinding machine has a data input for receiving positional information of the cams.

5. The grinding machine as claimed in claim 1, wherein the grinding machine has a measuring device for determining positional information of the cams.

6. The grinding machine as claimed in claim 5, wherein the measuring device comprises a laser or an initiator configured for contactless determination of the positional information of the cams on the camshaft workpiece.

7. The grinding machine as claimed in claim 5, further comprising a holder having a longitudinal stop, wherein the holder is configured to hold the camshaft workpiece and the measuring device is configured for determining at least a first position of one of the cams relative to the longitudinal stop of the holder of the workpiece.

8. The grinding machine as claimed in claim 7, wherein the measuring device is configured for determining a plurality of positions of the cams relative to the longitudinal stop of the holder of the camshaft workpiece.

9. The grinding machine as claimed in claim 7, wherein the measuring device is configured for determining positions of the cams relative to one another.

10. The grinding machine as claimed in claim 5, wherein the measuring device is arranged outside an interior space of the grinding machine.

11. The grinding machine as claimed in claim 5, wherein the measuring device is arranged within an interior space of the grinding machine.

12. The grinding machine as claimed in claim 1, wherein the control unit is configured in such a manner that the edges of the cams of the camshaft workpiece are deburred or chamfered with the two profile sections of the grinding wheel only after 60 to 80% of a total machining time for grinding with the grinding region running substantially parallel to the axis of rotation of the grinding wheel and for deburring or chamfering said workpiece.

13. A method for grinding a workpiece, in particular cams, on a holder with a grinding machine as claimed in claim 1, comprising the following steps:

a) determining the position of at least one workpiece on the holder, b) relaying positional information to a control unit for controlling the grinding operation, c) on the basis of the positional information, positioning the grinding wheel in a direction of the longitudinal axis of the holder of the at least one workpiece and perpendicularly to said longitudinal axis for a grinding operation, d) grinding the at least one workpiece with the grinding region of the grinding wheel, e) on the basis of the positional information, moving the grinding wheel in the direction of said longitudinal axis such that an oblique profile section of the grinding wheel deburrs or chamfers an edge of the at least one workpiece, wherein said profile section does not run parallel to the axis of rotation of the grinding wheel.

14. The method as claimed in claim 13, comprising the following further step:

f) on the basis of the positional information, moving the grinding wheel in an opposite direction to the longitudinal axis such that a further oblique profile section of the grinding wheel deburrs or chamfers a further edge of the workpiece, wherein said further profile section does not run parallel to the axis of rotation of the grinding wheel.

* * * * *